United States Patent [19]

Shewchuk

[11] Patent Number: 4,607,457

[45] Date of Patent: Aug. 26, 1986

[54] DOOR AND DOOR JAMB ARRANGEMENT

[76] Inventor: James G. Shewchuk, 1988 Pacific Avenue, Winnipeg, Manitoba, Canada, R2R 0G4

[21] Appl. No.: 709,771

[22] Filed: Mar. 8, 1985

[30] Foreign Application Priority Data

Apr. 12, 1984 [CA] Canada ..... 451885

[51] Int. Cl.[4] ..... E05D 7/00

[52] U.S. Cl. ..... 49/400; 49/501; 49/504; 49/488

[58] Field of Search ..... 49/488, 380, 383, 489, 49/399, 400, 501, 504; 52/213, 217

[56] References Cited

U.S. PATENT DOCUMENTS

| | | | |
|---|---|---|---|
| 2,930,086 | 3/1960 | Griffiths | 49/488 X |
| 2,970,347 | 2/1961 | Massopust | 49/501 |
| 3,019,493 | 2/1962 | Walenga | 49/399 |
| 3,403,476 | 10/1968 | Ciucani | 49/501 X |
| 3,407,553 | 10/1968 | Halpern | 52/217 |

FOREIGN PATENT DOCUMENTS

| | | | |
|---|---|---|---|
| 539521 | 4/1922 | France | 49/400 |

*Primary Examiner*—Kenneth Downey

*Attorney, Agent, or Firm*—Stanley G. Ade; Adrian D. Battison

[57] ABSTRACT

A door and door jamb assembly is provided either with a kit of parts or as an assembled unit and includes a door and surrounding door jamb together with mounting brackets for the door jamb and hinges for supporting the door on the door jamb. Both the inner surface of the door jamb and the outer peripheral edge of the door are tapered so that in the closed position they are closely adjacent and parallel with a sealing strip mounted in a recess around the periphery of the door edge. The door jamb is manufactured so as to provide a rigid structure which can be mounted on the frame of the building with the brackets which allow movement between the frame and the door jamb so that the door jamb remains rigid and rectangular despite any shifting of the building. A wiping compressing action of the seal on the tapered surface of the door jamb provides a large compressing force for the seal which improves the sealing effect.

5 Claims, 5 Drawing Figures

DOOR AND DOOR JAMB ARRANGEMENT

BACKGROUND OF THE INVENTION

This invention relates to a door and door jamb arrangement which may be provided as an assembled unit or as a kit of parts for assembly into the assembled unit including the door separately and the door jamb separately. The door is intended for use as the door of a building which may be the exterior door and hence is of a size to accommodate the passage of an erect adult human.

In recent years, as the cost of energy has increased substantially, close attention has been given to reducing or preventing drafts passing into a building from the exterior. This is particularly important in cold climates where the exterior temperature can be as much as 100° F. different from the interior temperature but will become of increasing importance in more temperature climates where the exterior temperature is unsuitable for comfortable living.

In this period of increased attention, various types of weatherstripping have been developed for conventional doors with the weatherstripping generally attached to the door jamb for cooperation with the peripheral edge of the door. Other types of weatherstripping are attached around the stopper of the door for cooperation with a strip of the outer face of the door around the periphery of the outer face.

However, these weatherstripping arrangements have been generally unsatisfactory in that they are often poorly fitting leaving spaces through which considerable draft can enter and also they often are damaged, requiring frequent replacement.

Other types of door have been developed for alternative end uses, for example, in water-tight bulkheads or in refrigerators or cold stores and generally these arrangements include a flange seal where an outer flange on the door includes a seal on the front face thereof which engages around the door jamb or bulkhead. The serious problem with this type of door is that it requires a considerable force to close the door and to compress the seal to obtain the necessary sealing action.

It is therefore unsatisfactory in the normal household or building use where it is undesirable to clamp the door into place with the necessary levers or screw couplings.

SUMMARY OF THE INVENTION

It is one object of the present invention, therefore, to provide an improved door and door jamb arrangement which can be used as the exterior door of a building and which can provide a seal around the periphery of the door.

According to the invention, therefore, there is provided a door and door jamb arrangement for a doorway of a building comprising a door having a front surface, a rear surface each having edges defining a top edge, a bottom edge and two side edges of the door spaced to allow the passage through the doorway of an erect adult human and a peripheral edge surface surrounding and interconnecting the front and rear surfaces including a top portion, a bottom portion and two side portions, a door jamb having an inner surface for surrounding the peripheral edge surface of the door and for cooperating therewith to form a seal surrounding the door, hinge means for mounting the door on the door jamb for pivotal movement about one side edge of the door and elongate sealing means supported by, extending along and projecting outwardly from one of the inner surface and the peripheral edge surface for engaging the other of the inner surface and the peripheral edge surface to form a seal therewith, at least the top and bottom portions and the other side portion of the other of said inner surface and said peripheral edge surface being tapered in a direction so as to incline relative to a plane which is at right angles to the front surface and which includes a portion of the edge of the front surface adjacent to said portions whereby said sealing means is compressed by sliding movement against said tapered portions caused by a closing movement of the door into the door jamb.

Preferably, the sealing means is arranged around the peripheral edge surface of the door with both the peripheral edge surface of the door and the inner surface of the door jamb being tapered so that in the closed position of the door, the surfaces lie closely adjacent with the sealing means compressed between the surfaces. In this way, the compression of the sealing means in the form of a peripheral resilient sealing strip occurs during a closing movement. The taper of the surface opposite the sealing strip which is preferably at an angle of the order of 12° means that a component of the force closing the door is taken to gradually compress the sealing strip as opposed to flange-type doors where the sealing strip is compressed directly by force in the direction of compression.

According to another preferred feature, the door jamb in assembled is formed as a rigid substantially rectangular body surrounding the door frame so that the door jamb can be hung from the frame of a building in such a manner that it is not distorted by movement of the frame of the building. In this way, the door and door jamb can remain permanently accurately fitting with the taper provided at all four sides.

According to a further preferable feature, the hinges along one side of the door preferably include a recess in the plate attaching to the door so that the peripheral sealing strip can pass through the recess at the hinge and provide a sealing at the hinge which is continuous with the sealing around the remainder of the door.

In view of the fact that the contact between the door and the door jamb occurs between the sealing strip and the tapered surface, there is no necessity for a door stopping and this is therefore preferably omitted. In this way, the position at which the door terminates its closing movement is controlled by the compression of the sealing strip to ensure that the sealing strip is properly compressed and thus the complete compression of the sealing strip is obtained in all cases without the necessity for adjustment even when the resilience and size of the sealing strip changes due to temperature change or wear.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
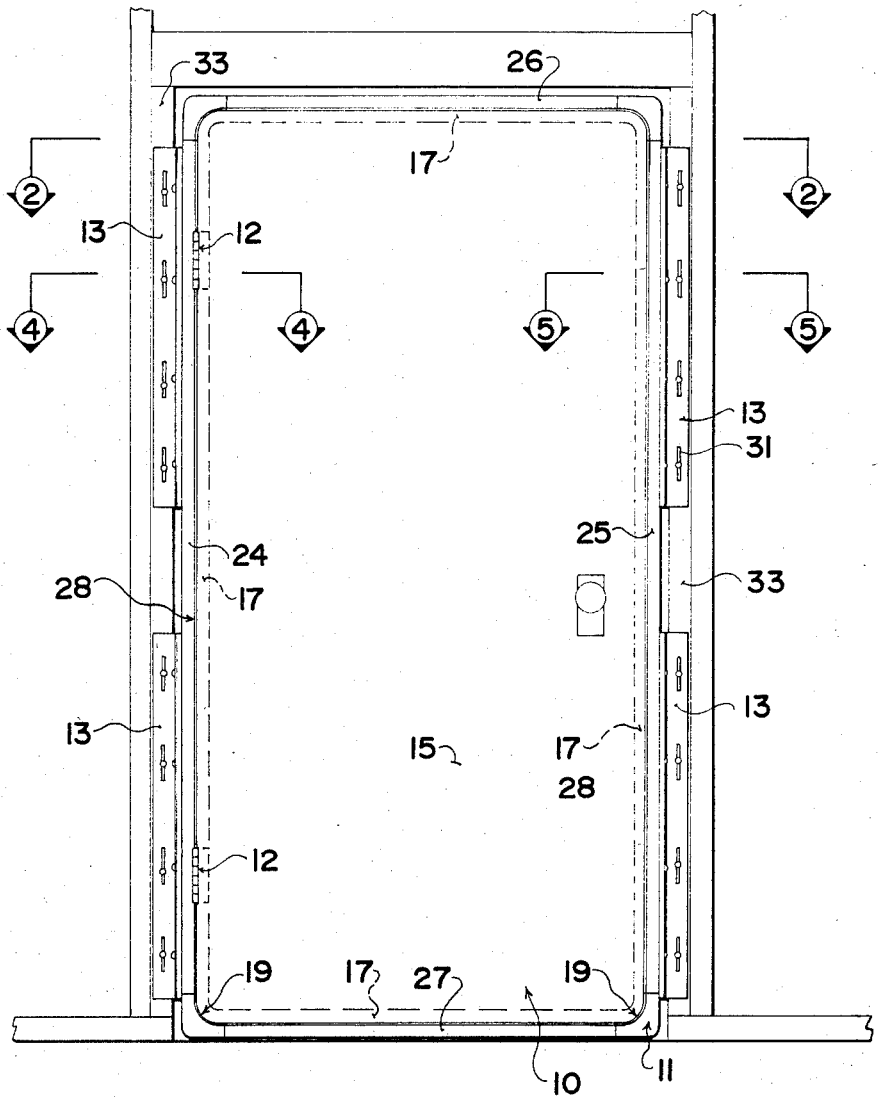
FIG. 1 is a front elevational view of a door and door jamb in assembled position in a building.

The door and door jamb arrangement is shown in assembled form in FIG. 1, but it will be appreciated that it can comprise a kit of parts which is sold as a kit or in individual members for assembly into the assembled condition shown in FIG. 1.

Figure 2:
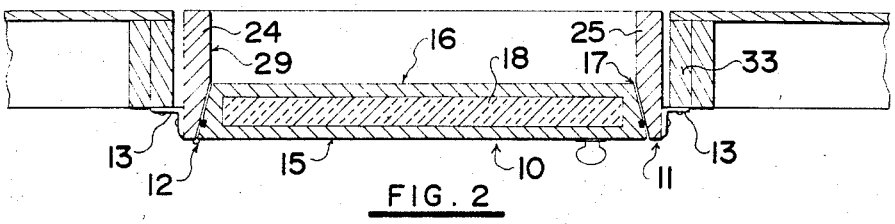
FIG. 2 is a cross sectional view along the lines 2—2 of FIG. 1.
Figure 5:
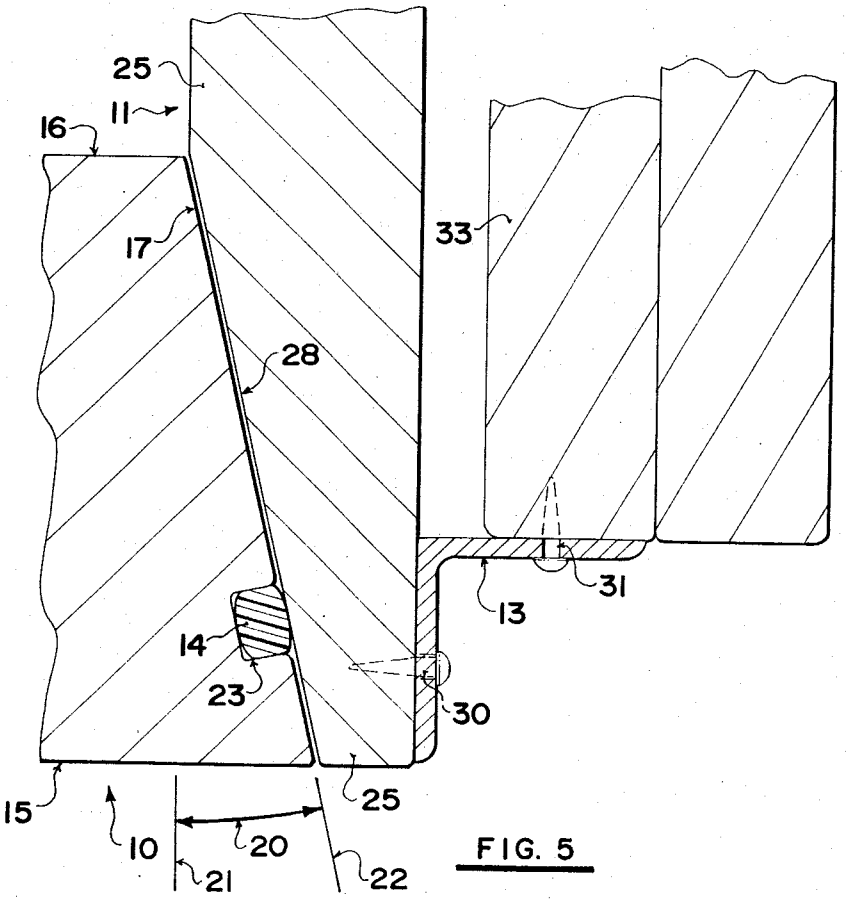
FIG. 5 is a cross sectional view along the lines 5—5 of FIG. 1.
Figure 4:
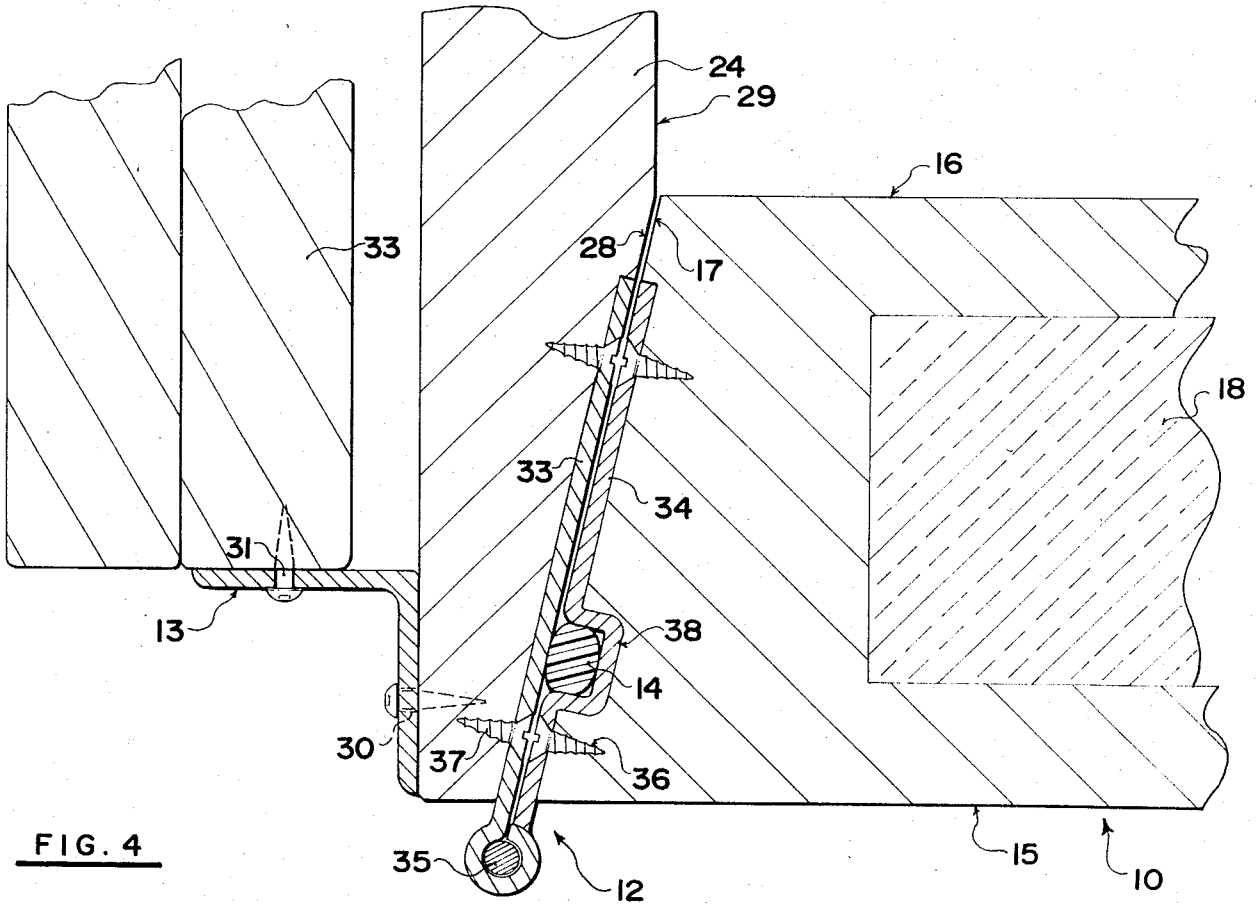
FIG. 4 is a cross sectional view along the lines 4—4 of FIG. 1.

Thus, the kit comprises a door generally indicated at 10, a door jamb generally indicated at 11, a pair of hinges schematically indicated in FIG. 1 at 12, four mounting brackets for mounting the door jamb on the frame of the building each shown at 13 in FIG. 1 and a sealing strip 14 which is not visible in FIG. 1 but is shown in FIGS. 2, 4 and 5.

Turning firstly to the structure of the door, this comprises a front surface 15, a rear surface 16 and a peripheral edge 17 joining the front and rear surfaces. The door is preferably formed from a pair of parallel wood or wood-type panels built on a suitable frame and filled with an insulation material 18.

The structure of the frame and panels is not illustrated and will not be described in detail as this will be within the knowledge of one skilled in the art.

In other cases, the door can be formed from other materials such as aluminum or sheet steel, but this is not preferred since it will have different expansion characteristics relative to the wooden frame surrounding the door jamb and the door jamb itself.

The peripheral edge 17 has, of course, a top, bottom and two sides which are dimensioned suitably for conventional household use, that is to allow the passage of an erect adult human with minimum sizes being dictated by building regulations.

The four corners of the door which is generally rectangular in shape are radiused as indicated at 19 with a radius of curvature which can be of the order of 1.5 inches.

The front face 15 is of larger extent than the rear face 16 so that the peripheral edges 17 are all tapered through an angle 20 as shown in FIG. 5 which can lie in the range of 8° to 20° and is preferably of the order of 12°. The taper also is applied at the radiused corners 19 so that at each point on the peripheral edge a line through the peripheral edge intersecting the front and rear surfaces at right angles thereto lies at an angle to the line 21 shown in FIG. 5 which passes through the intersection of the inclined line 22 with the rear face 16. The line 21 is normal to the plane of the rear surface 16.

A recess 23 is provided in the peripheral edge 17 around the full peripheral extent thereof, the recess being rectangular in shape and arranged closer the front surface 15 than the rear surface 16. The recess 23 receives the resilient sealing strip 14 which can, for example, be a cylindrical bead. One example which is suitable is a 7/16 inch sponge lace which fits into a $\frac{3}{8}$ inch × 5/16 inch recess or groove in the outer periphery of the door.

The door jamb 11 is formed as a rigid unit including two sides 24 and 25, a top 26 and a bottom 27 each of which is of the cross sectional shape illustrated in FIG. 2 including a tapered section 28 which is shaped to match the outer tapered edge 17 of the door 10 and a rectangular section 29. The complete thickness of the door jamb is sufficient to bridge the thickness of the wall concerned and is therefore generally of the order of 8 inches or 6 inches in width.

It will be noted that the door jamb is free from a door stopping and therefore the only interconnection between the door and the door jamb is provided by the tapered edge 17 and the inner tapered surface 28. The top, bottom and sides are interconnected by corner pieces 30 which are radiused to match the radius of the corners 19 of the door. The structure of the door jamb is of a type that it can remain rigid and in fixed rectangular position and is generally manufactured from wood although of course other materials can be suitable. The detailed structure is not shown or described since it will be within the skill of one skilled in the art.

Figure 3:
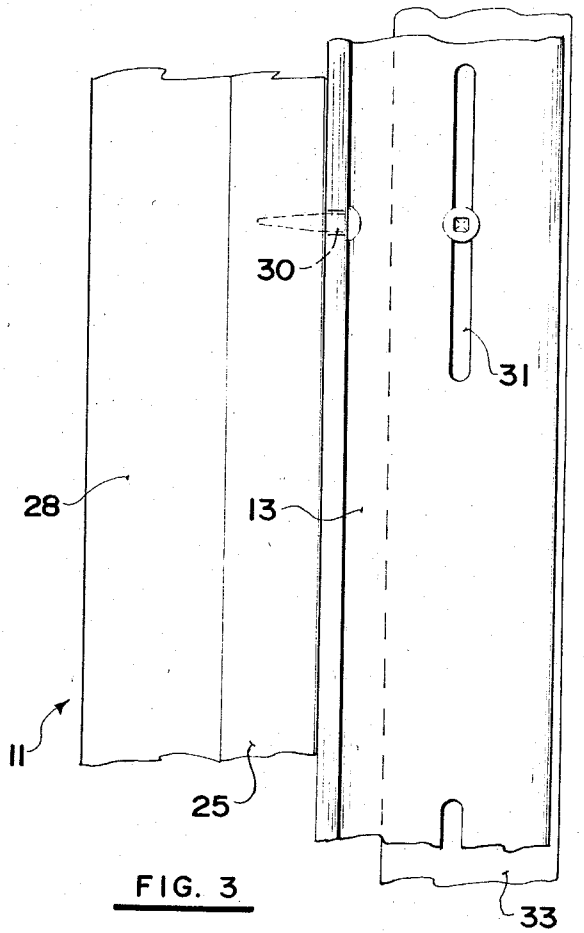
FIG. 3 is a front elevational view of a portion of the door jamb and mounting arrangement of FIG. 1 on a substantially increased scale.

In mounting of the jamb into the frame of the building, the jamb is attached by the brackets 13 which are right-angled brackets of a length less than half the height of the frame so that four such brackets can be used, two along each side of the door jamb. The angle brackets 13 have a plurality of holes 30 shown in FIGS. 3 and 5 in one leg and a plurality of slots 31 in the other leg of the angle.

The angle brackets 13, therefore, can be used to screw by screws 32 the door jamb to the frame indicated at 33 of the building in such a way that the door jamb can shift relative to the frame should the frame move due to settling or heaving of the building.

In particular, the bottom or sill 27 of the door jamb can rest upon a bat of fibreglass insulation on a rigid wall of the building with the vertical jamb members 24, 25 secured to the house frame by the slotted angles 13. Thus, the jamb is free to float relative to the frame by the extent of the slots 31.

One of the hinges 12 shown schematically in FIG. 1 is illustrated in cross section in FIG. 4 and comprises a pair of plates 33, 34 interconnected by a hinge pin 35 generally of conventional construction. Openings 36 are provided in the plates 33 and 34 to allow them to be screwed to the jamb and to the door respectively by screws 37.

In order to accommodate the sealing strip or bead 14, a recess 38 is formed in the plate 34 attached to the door so that the strip 14 can pass through the hinge continuously along the edge 17 of the hinged side of the door. The recess 38 is formed by four right-angled bends in the plate 34 so that the plate, when attached to the door, includes a portion which extends to the bottom of the recess in the door, the recess adjacent the hinge being increased slightly in size to accommodate the thickness of the plate 34.

The kit of parts including the above-identified and described items can be assembled by a contractor or by, in some cases, the householder into the door and door jamb assembly illustrated in FIG. 1. Suitable door locking and door handle arrangements can be provided as will be apparent to one skilled in the art at a position so that they do not interfere with the peripherally extending sealing ring 14.

The door and door jamb therefore provides a seal which extends fully around the peripheral extent of the door and therefore is very effective against preventing drafts. The radiused corners 19 avoid sharp angles which are difficult to fit and difficult to accurately seal. The fact that the sealing strip 14 is positioned on the outside of the door rather than on the door jamb reduces its exposure to damage from persons or objects passing through the doorway and particularly at ground level where the sealing strip if positioned on the door jamb can be damaged by the feet of the passing persons.

In addition, the taper of the door and the distance beyond the edge of the door which the sealing strip 14 extends are arranged so that as the door closes the sealing strip contacts firstly the tapered surface of the door jamb rather than the edge of the door jamb and is then gradually pressed into a compressed state by a sliding movement of the sealing strip along the tapered surface of the door jamb. Since the angle of taper is relatively small,the amount of force necessary in a door closing direction is relatively small in comparison with the amount of force which is thus generated generally at right angles to the door closing direction to compress the sealing strip.

In order to adjust the closing of the door relative to the door jamb, the hinges can be slotted in a direction at right angles to the door frame.

In alternative arrangements (not shown) the sealing strip could in fact be mounted on the door jamb rather than the door itself with the sealing strip cooperating with a tapered edge of the door to provide the sweeping compressing action required. This is, of course, disadvantageous in that the sealing strip is more exposed but could be satisfactory in some circumstances.

In addition, it is possible that the surface on which the sealing strip is mounted is not tapered but is shaped merely to expose the sealing strip to the tapered surface of the opposing body provided by the door or door jamb since there is generally no contact between the tapered surfaces, the only contact taking place between one tapered surface and the opposing sealing strip.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A door and door jamb arrangement for a doorway of a building comprising a door having a front surface, a rear surface each having edges defining a top edge, a bottom edge and two side edges of the door spaced to allow the passage through the doorway of an erect adult human and a peripheral edge surface surrounding and interconnecting the front and rear surfaces including a top portion, a bottom portion and two side portions, a door jamb which is a rigid integral unit for fully surrounding the door and which has a plain inner surface free from resilient sealing means for surrounding the periphral edge surface of the door and for cooperating therewith to form a seal surrounding the door, said top portion, bottom portion and side portions of the peripheral edge of the door and of the inner surface of the door jamb being arranged to form substantially a rectangle with the corners thereof radiused and being shaped such that the only contact between the door and the jamb occurs between the peripheral surface of the door and the inner surface of the jamb, hinge means for mounting the door on the door jamb for pivotal movement about one side edge of the door, means for mounting the rigid door jamb on a building frame so as to accommodate movement of the frame relative to the jamb, and elongate sealing means supported by, extending along and projecting outwardly from the peripheral edge surface for engaging the plain inner surface to form a seal therewith, at least the top and bottom portions and the other side portion of both said inner surface and said peripheral edge surface being tapered in a direction so as to incline relative to a plane which is at right angles to the front surface and which includes a portion of the edge of the front surface adjacent to said portions and so that in the closed position of the door the inner surface and peripheral edge surface lie in close parallel relationship whereby said sealing means is compressed by sliding movement against said tapered portions caused by a closing movement of the door into the door jamb.

2. The assembly according to claim 1
wherein the hinge means includes a recess for receiving said sealing means.

3. The invention according to claim 1
wherein the angle of taper lies in the range of 8° to 20°.

4. The invention according to claim 3
wherein the angle of taper is of the order of 12°.

5. The invention according to claim 1
wherein the door is formed from a pair of spaced panels and a layer of insulation material formed between said panels.

* * * * *